US008085958B1

(12) United States Patent
Trautmann et al.

(10) Patent No.: US 8,085,958 B1
(45) Date of Patent: Dec. 27, 2011

(54) VIRTUALIZER SWEET SPOT EXPANSION

(75) Inventors: Steven Trautmann, Ibaraki-ken (JP); Atsuhiro Sakurai, Ibaraki-ken (JP); Akihiro Yonemoto, Tokyo (JP)

(73) Assignee: Texas Instruments Incorporated, Dallas, TX (US)

( * ) Notice: Subject to any disclaimer, the term of this patent is extended or adjusted under 35 U.S.C. 154(b) by 1216 days.

(21) Appl. No.: 11/752,723

(22) Filed: May 23, 2007

Related U.S. Application Data

(60) Provisional application No. 60/804,486, filed on Jun. 12, 2006.

(51) Int. Cl.
*H04R 5/02* (2006.01)

(52) U.S. Cl. ..... 381/310; 381/17; 381/309

(58) Field of Classification Search ..... 381/1, 17–18, 381/309–310
See application file for complete search history.

(56) References Cited

U.S. PATENT DOCUMENTS 7,215,782 B2 * 5/2007 Chen ..... 381/17
2005/0078833 A1 * 4/2005 Hess et al. ..... 381/26

* cited by examiner

*Primary Examiner* — Devona E Faulk
*Assistant Examiner* — Disler Paul
(74) *Attorney, Agent, or Firm* — Mima Abyad; Wade J. Brady, III; Frederick J. Telecky, Jr.

(57) ABSTRACT

Audio loudspeaker virtualizers and cross-talk cancellers and methods use a combination of interaural intensity difference and interaural time difference to define virtualizing filters. This allows enlargement of a listener's sweet spot based on psychoacoustic effects.

5 Claims, 8 Drawing Sheets

VIRTUALIZER SWEET SPOT EXPANSION

CROSS-REFERENCE TO RELATED APPLICATIONS

This application claims priority from provisional patent application No. 60/804,486 filed Jun. 12, 2006. The following co-assigned copending patent applications disclose related subject matter: application Ser. Nos. 11/364,117 and 11/364,971, both filed Feb. 28, 2006.

BACKGROUND OF THE INVENTION

The present invention relates to digital audio signal processing, and more particularly to loudspeaker virtualization and cross-talk cancellation devices and methods.

Multi-channel audio inputs designed for multiple loudspeakers can be processed to drive a single pair of loudspeakers and/or headphones to provide a perceived sound field simulating that of the multiple loudspeakers. In addition to creation of such virtual speakers for surround sound effects, signal processing can also provide changes in perceived listening room size and shape by control of effects such as reverberation.

Multi-channel audio is an important feature of DVD players and home entertainment systems. It provides a more realistic sound experience than is possible with conventional stereophonic systems by roughly approximating the speaker configuration found in movie theaters. FIG. 14 illustrates an example of multi-channel audio processing known as "virtual surround" which consists of creating the illusion of a multi-channel speaker system using a conventional pair of loudspeakers. This technique makes use of transfer functions from virtual loudspeakers to a listener's ears; that is, transfer functions made from the head-related transfer function (HRTF) of the direct path and of all the reflections of the virtual listening environment. A room transfer function is largely unknown, but the actual HRTFs (which are functions of the angles between source direction and head direction) can be approximated by use of a library of measured HRTFs. For example, Gardner, Transaural 3-D Audio, MIT Media Laboratory Perceptual Computing Section Technical Report No. 342, Jul. 20, 1995, provides HRTFs for every 5 degrees (azimuthal).

FIG. 15 shows functional blocks of an implementation for the (real plus virtual) speaker arrangement of FIG. 14; this requires cross-talk cancellation for the real speakers as shown in the lower right of FIG. 15. Here cross-talk denotes the signal from the right speaker that is heard at the left ear and vice-versa. The basic solution to eliminate cross-talk was proposed in U.S. Pat. No. 3,236,949 and is explained as follows. Consider a listener facing two loudspeakers as shown in FIG. 13. Let $X_1(e^{j\omega})$ and $X_2(e^{j\omega})$ denote the (short-term) Fourier transforms of the analog signals which drive the left and right loudspeakers, respectively, and let $Y_1(e^{j\omega})$ and $Y_2(e^{j\omega})$ denote the Fourier transforms of the analog signals actually heard at the listener's left and right ears, respectively. Presuming a symmetrical speaker arrangement, the system can then be characterized by two HRTFs, $H_1(e^{j\omega})$ and $H_2(e^{j\omega})$, which respectively relate to the short and long paths from speaker to ear; that is, $H_1(e^{j\omega})$ is the transfer function from left speaker to left ear or right speaker to right ear, and $H_2(e^{j\omega})$ is the transfer function from left speaker to right ear and from right speaker to left ear. This situation can be described as a linear transformation from $X_1, X_2$ to $Y_1, Y_2$ with a 2×2 matrix having elements $H_1$ and $H_2$ $$\begin{bmatrix} Y_1 \\ Y_2 \end{bmatrix} = \begin{bmatrix} H_1 & H_2 \\ H_2 & H_1 \end{bmatrix} \begin{bmatrix} X_1 \\ X_2 \end{bmatrix}$$

Note that the dependence of $H_1$ and $H_2$ on the angle that the speakers are offset from the facing direction of the listener has been omitted.

FIG. 16 shows a cross-talk cancellation system in which the input electrical signals (short-term Fourier transformed) $E_1(e^{j\omega})$, $E_2(e^{j\omega})$ are modified to give the signals $X_1, X_2$ which drive the loudspeakers. (Note that the input signals $E_1, E_2$ are the recorded signals, typically using either a pair of moderately-spaced omni-directional microphones or a pair of adjacent uni-directional microphones with an angle between the two microphone directions.) This conversion from $E_1, E_2$ into $X_1, X_2$ is also a linear transformation and can be represented by a 2×2 matrix. If the target is to reproduce signals $E_1, E_2$ at the listener's ears (so $Y_1=E_1$ and $Y_2=E_2$) and thereby cancel the effect of the cross-talk (due to $H_2$ not being 0), then the 2×2 matrix should be the inverse of the 2×2 matrix having elements $H_1$ and $H_2$. That is, taking $$\begin{bmatrix} X_1 \\ X_2 \end{bmatrix} = \begin{bmatrix} H_1 & H_2 \\ H_2 & H_1 \end{bmatrix}^{-1} \begin{bmatrix} E_1 \\ E_2 \end{bmatrix} = \frac{1}{H_1^2 - H_2^2} \begin{bmatrix} H_1 & -H_2 \\ -H_2 & H_1 \end{bmatrix} \begin{bmatrix} E_1 \\ E_2 \end{bmatrix}$$

yields $Y_1=E_1$ and $Y_2=E_2$.

An efficient implementation of the cross-talk canceller diagonalizes the 2×2 matrix having elements $H_1$ and $H_2$ $$\begin{bmatrix} H_1 & H_2 \\ H_2 & H_1 \end{bmatrix} = \frac{1}{2} \begin{bmatrix} 1 & 1 \\ 1 & -1 \end{bmatrix} \begin{bmatrix} M_0 & 0 \\ 0 & S_0 \end{bmatrix} \begin{bmatrix} 1 & 1 \\ 1 & -1 \end{bmatrix}$$

where $M_0(e^{j\omega})=H_1(e^{j\omega})+H_2(e^{j\omega})$ and $S_0(e^{j\omega})=H_1(e^{j\omega})-H_2(e^{j\omega})$. Thus the inverse becomes simple to compute:

$$\begin{bmatrix} H_1 & H_2 \\ H_2 & H_1 \end{bmatrix}^{-1} = \frac{1}{2} \begin{bmatrix} 1 & 1 \\ 1 & -1 \end{bmatrix} \begin{bmatrix} 1/M_0 & 0 \\ 0 & 1/S_0 \end{bmatrix} \begin{bmatrix} 1 & 1 \\ 1 & -1 \end{bmatrix}$$

And the cross-talk cancellation is efficiently implemented as sum/difference detectors with the inverse filters $1/M_0(e^{j\omega})$ and $1/S_0(e^{j\omega})$. This structure is referred to as the "shuffler" cross-talk canceller. U.S. Pat. No. 5,333,200 discloses this plus various other cross-talk signal processing.

Now with cross-talk cancellation, the FIG. 14 virtual plus real loudspeaker arrangement can be simply created by use of the HRTFs for the offset angles of the speakers. In particular, let $H_1(\theta)$ and $H_2(\theta)$ denote the two HRTFs for a speaker offset by angle θ (or 360−θ by symmetry) from the facing direction of the listener. If the (short-term Fourier transform) of the speaker signal is denoted SS, then the corresponding left and right ear signals $E_1$ and $E_2$ would be $H_1(\theta)\cdot SS$ and $H_2(\theta)\cdot SS$, respectively. These ear signals would be used as previously described for inputs to the cross-talk canceller; the cross-talk canceller outputs then drive the two real speakers to simulate a speaker at an angle θ and driven by source SS.

For example, the left surround sound virtual speaker could be at an azimuthal angle of about 250 degrees. Thus with cross-talk cancellation, the corresponding two real speaker inputs to create the virtual left surround sound speaker would be:

$$\begin{bmatrix} X_1 \\ X_2 \end{bmatrix} = \frac{1}{H_1^2 - H_2^2}\begin{bmatrix} H_1 & -H_2 \\ -H_2 & H_1 \end{bmatrix}\begin{bmatrix} TF3_{left} \cdot LSS \\ TF3_{right} \cdot LSS \end{bmatrix}$$

where $H_1$, $H_2$ are for the left and right real speaker angles (e.g., 30 and 330 degrees), LSS is the (short-time Fourier transform of the) left surround sound signal, and $TF3_{left}=H_1(250)$, $TF3_{right}=H_2(250)$ are the HRTFs for the left surround sound speaker angle (250 degrees).

Again, FIG. 15 shows functional blocks for a virtualizer with the cross-talk canceller to implement 5-channel audio with two real speakers as in FIG. 14; each speaker signal is filtered by the corresponding pair of HRTFs for the speaker's offset angle and distance, and the filtered signals summed and input into the cross-talk canceller and then into the two real speakers.

Unfortunately, the transfer functions from the speakers to the ears depend upon the individual's head-related transfer functions (HRTFs) as well as room effects and therefore are not completely known. Instead generalized HRTFs are used to approximate the correct transfer function. Usually generalized HRTFs are able to create a sweet-spot for most listeners, especially when the room is fairly non-reverberant and diffuse.

However, the sweet spot can be quite a small region. That is, to perceive the virtualized sound field properly, a listener's head cannot move much from the central location used for the filter design with HRTFs and cross-talk cancellation. Thus there is a problem of small sweet spot with the current virtualization filter design methods.

SUMMARY OF THE INVENTION

The present invention provides virtualization filter designs and methods which balance interaural intensity difference and interaural time difference. This allows for an expansion of the sweet spot for listening.

DESCRIPTION OF THE PREFERRED EMBODIMENTS

1. Overview

Figure 1:
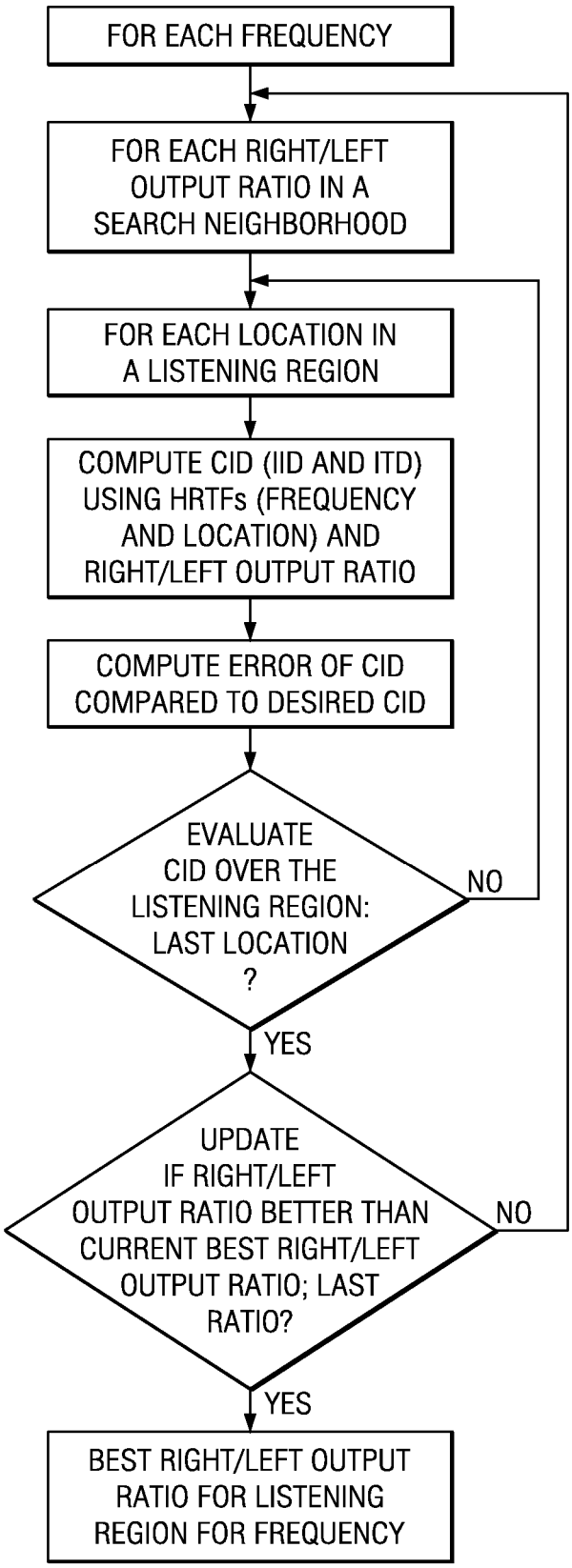
FIG. 1 is a flowchart.

Preferred embodiment cross-talk cancellers and virtualizers for multi-channel audio expand the small "sweet spot" for listening locations relative to real speakers into a larger "sweet space" by modifying (as a function of frequency) the relative speaker outputs in accordance with a psychoacoustic trade-off between the Interaural Time Difference and the Interaural Intensity Difference. These modified speaker outputs are used in a virtualizing filter; and this makes direction virtualization more robust. FIG. 1 is a flowchart.

Preferred embodiment systems implement preferred embodiment virtualizing filters with any of several types of hardware: digital signal processors (DSPs), general purpose programmable processors, application specific circuits, or systems on a chip (SoC) such as combinations of a DSP and a RISC processor together with various specialized programmable accelerators such as for FFTs and variable length coding (VLC). A stored program in an onboard or external flash EEPROM or FRAM could implement the signal processing.

2. Pyschoacoustic Basis

The preferred embodiments enlarge the listener's sweet spot by consideration of how directional perception is affected by listener movement within the sound field. Three basic psychoacoustic clues determine perception of the direction of a sound source: (1) Interaural Intensity Difference (IID) which refers to the relative loudness between the two ears of a listener; (2) Interaural Time Difference (ITD) which refers to the difference of times of arrival of a signal at the two ears (generally, people will perceive sounds as coming from the side which is louder and where the signal arrives earlier); and (3) the HRTF, which not only includes IID and ITD, but also frequency dependent filtering which helps clarify direction, because many directions can have the same IID and ITD.

An interesting experiment was performed in the early 1970's by Madsen to determine the effect on perception of direction when IID and ITD do not agree. It turns out that these clues can compensate for each other to a certain degree. For instance if the sound is louder in one ear but arrives earlier in the other ear by the correct amount of time, the sound will be perceived as centered. By finding the IID that compensates for a given ITD, a trade-off function can be established. A very simple approximation to this function is given as $$\begin{aligned} \text{trade_amount(dB)} &= 22.518296\ ITD^2 \quad \text{if} |ITD| \le 0.73(\text{ms}) \\ &= 12(\text{dB}) \qquad \text{otherwise} \end{aligned}$$

Note that the direction of the trade amount is to the side of the head where the sound arrives first. For example, if a sound reaches the left ear 0.5 ms prior to reaching the right ear, but if the sound intensity at the right ear is about 5.6 dB larger than at the left ear, then this sound will be perceived as originating from a centered source.

Since a sweet space is to be located in a typical listening environment, certain assumptions can be made about the position and orientation of the loudspeakers and listeners. First it is assumed that the speakers are identical uniform point sources. This simplification is not necessary however. What is important is to have the best possible knowledge of the transfer functions between the speakers and the listener at all relevant locations. If some a priori knowledge about the directional response of the speakers at individual frequencies is known, it should be used. The assumption of point sources is to keep things as general as possible. The transfer functions between the speakers and the listener's ears are based on the usual HRTFs. However, the actual transfer functions used are based on angular adjustment and HRTF interpolation. Again the goal is just to have the most accurate transfer functions from the speakers to the listener's ears as possible, so in this sense other HRTF interpolation methods could be used, as long as they also work reasonably well. Two scenarios were considered, one where the listeners always face directly forward, orthogonal with the line connecting the speaker positions. In the second scenario the listeners were always facing the mid-point between the two speakers, as if watching a small TV. Since there is very little difference between the two scenarios, only the facing forward scenario will be considered.

Figure 14:
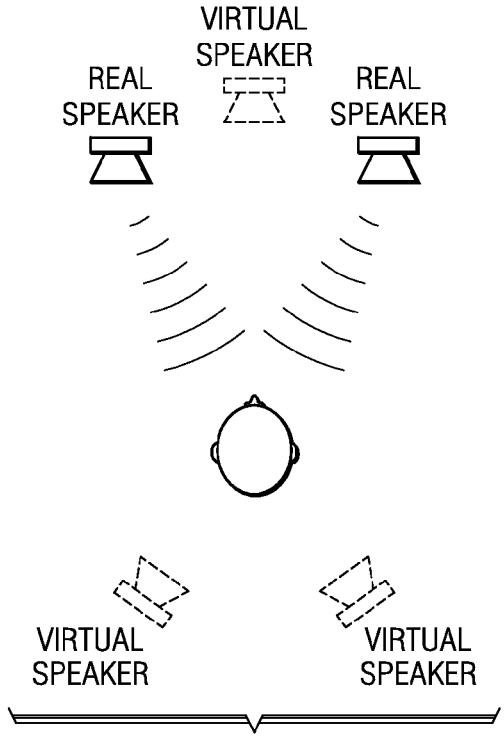
FIG. 14 (PRIOR ART)
Figure 15:
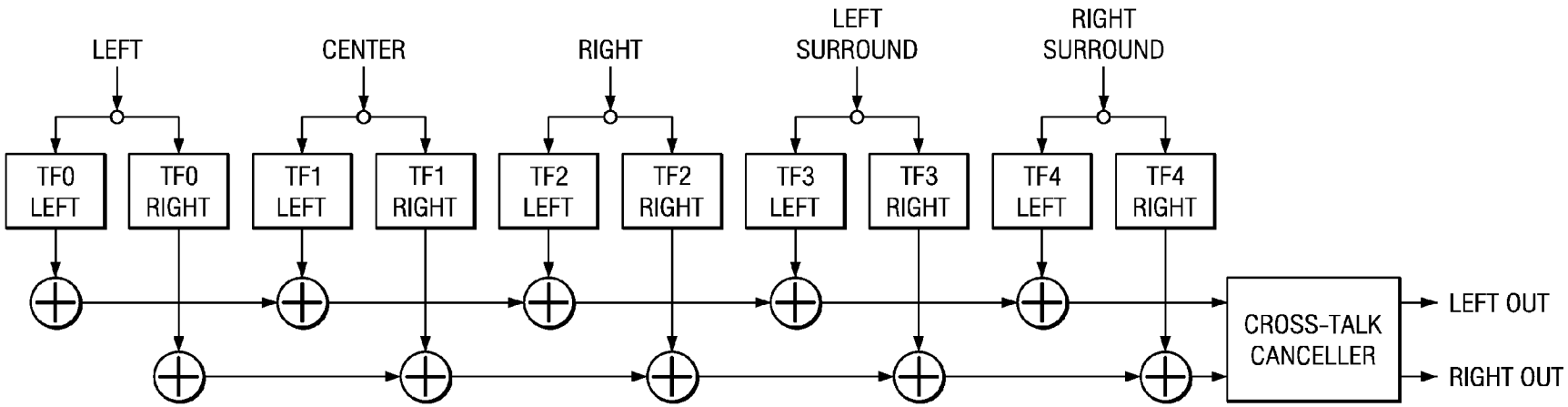
FIG. 15 (PRIOR ART)
FIG. 15 shows virtualizing filter arrangements.

Since one of the goals of the preferred embodiments is to create a virtual surround speaker environment using two speakers, the virtual speaker is assumed to be located at 110 degrees to the left (250 degrees azimuth), at the target virtual left rear surround speaker position. The actual speaker positions were assumed to be at 30 degrees left and 30 degrees right of the center position. FIG. 14 shows the setup. Note the speakers are considered to be only 1 meter from the center listening location in the examples that follow.

Figure 2:
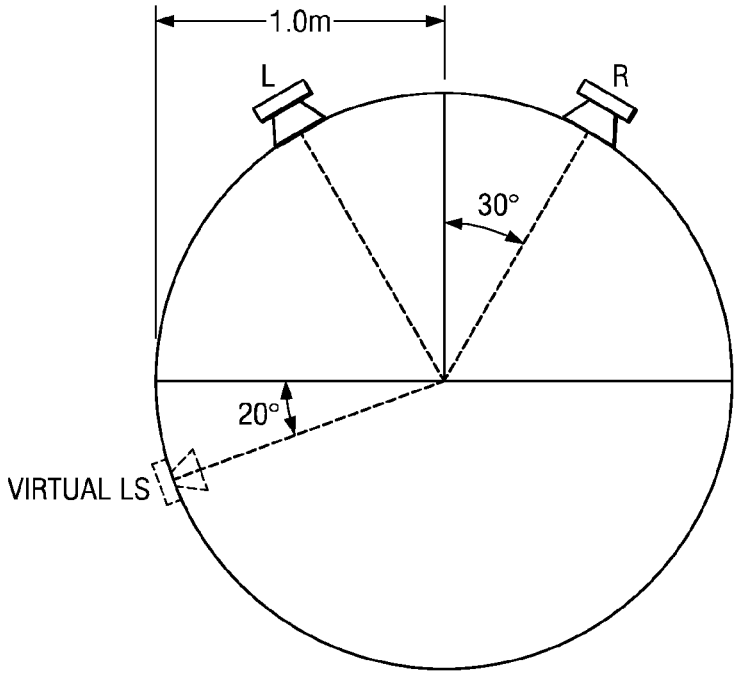
FIG. 2 illustrates an experimental setup.
Figure 16:
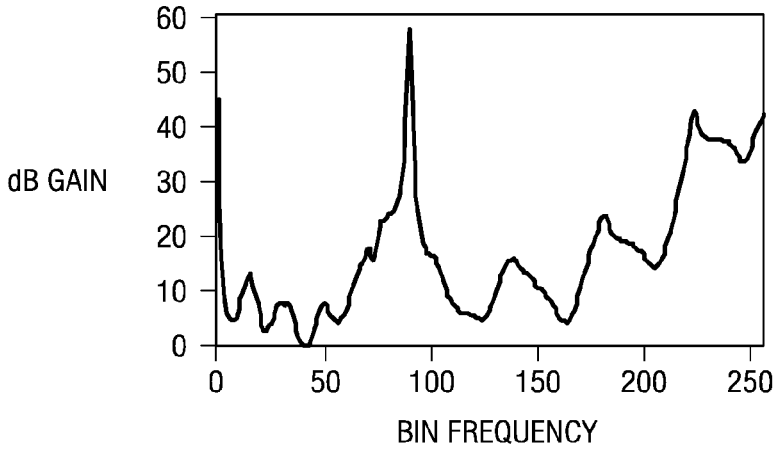
FIG. 16 (PRIOR ART)
FIG. 16 shows cross-talk cancellation.

We begin by examining normal cross-talk cancellation as described above at a particular frequency when simulating the virtual source shown in FIG. 2. First the target IID and ITD are determined from the virtual source's transfer functions. For a listener at the center listening position, at 516.8 Hz, the IID is 15.24 dB and the IIT is 0.689 ms. That is, for a listener at the center listening position a 516.8 Hz sound from a source at the left surround location would appear 15.24 dB louder at the left ear than at the right ear ($20\log(|Y_1|^2/|Y_2|^2)=15.24$) and would arrive 0.689 ms earlier at the left ear than at the right ear ($\arg(Y_1)=\arg(Y_2)-0.000689*2\pi f$). Since we are considering only the difference in dB and ms between signals at the two ears, it turns out that only the amplitude and phase difference between the two speakers matter at this point. Therefore, to simplify things, the amplitude and phase of the signals at the speakers are represented by complex numbers. Furthermore, the signal at the left speaker is fixed to the complex number 1+0j, while only the right speaker's complex number is allowed to vary and thereby represents the ratio of right to left. As described in the background, the left speaker's output and the right speaker's output are transformed by a 2×2 matrix of HRTFs to give the signals received at the listener's ears. At a particular frequency, represented in radians per second by ω, the transfer functions $H_k$ are represented by a frequency response at that frequency, $H_k(e^{j\omega})$, which is just a complex number representing the change in amplitude and phase due to the transfer function from the speakers to the listener's ears. That is, with $H_k(e^{j\omega})=\mathrm{Re}\{H_k\}+j\mathrm{Im}\{H_k\}$:

$$\begin{bmatrix} z_L \\ z_R \end{bmatrix} = \begin{bmatrix} \mathrm{Re}\{H_1\}+j\mathrm{Im}\{H_1\} & \mathrm{Re}\{H_2\}+j\mathrm{Im}\{H_2\} \\ \mathrm{Re}\{H_3\}+j\mathrm{Im}\{H_3\} & \mathrm{Re}\{H_4\}+j\mathrm{Im}\{H_4\} \end{bmatrix} \begin{bmatrix} 1+j0 \\ x+jy \end{bmatrix}$$

Since the listener is not necessarily in a central position, these four complex numbers can be all different. Indeed, $H_1(e^{j\omega})$ and $H_3(e^{j\omega})$ are the short and long paths from the left speaker to the left and right ears, respectively, and $H_4(e^{j\omega})$ and $H_2(e^{j\omega})$ are the short and long paths from the right speaker to the right and left ears, respectively.

Thus for each frequency and each head location, the problem is to solve for the ratio of real speaker outputs (i.e., x+jy) which will yield the desired virtual speaker signals at the ears (i.e., $z_L$, $z_R$) where the four complex matrix elements $\mathrm{Re}\{H_k\}+j\mathrm{Im}\{H_k\}$ are determined by the frequency and head location using (interpolated) standard HRTFs.

First, note that the IID in dB is determined as:

$$\mathrm{IID}=20\log_{10}(|z_L|)-20\log_{10}(|z_R|)=20\log_{10}(|z_L|/|z_R|)$$

Next, the ITD is a little bit trickier because the time difference must be calculated from the phase difference. The ITD in milliseconds (ms) is determined by:

$$\mathrm{ITD}=1000(arg(z_L)-arg(z_R))/2\pi f$$

where f is the frequency in Hz and arg denotes the argument of a complex number and lies in the range $-\pi<\arg(z)\leqq\pi$. Note that this formula is only valid at frequencies less than about 1 kHz, because the wavelength has to be at least twice the width of the head. The absolute error of the IID and ITD are both defined simply as the absolute value of the result of the target value minus the achieved value.

Figure 3:
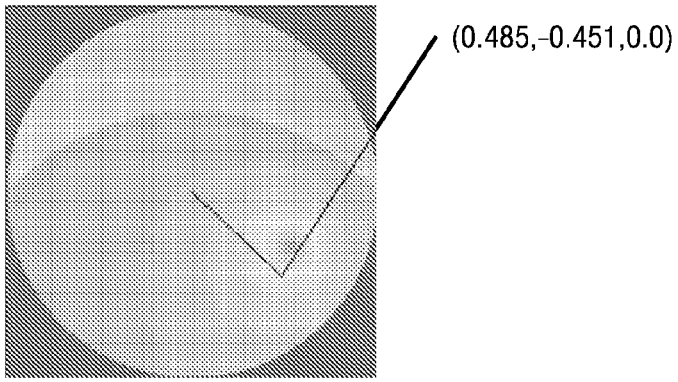
FIGS. 3-12 are experimental results.

A plot of the absolute error in resulting IID as the ratio of right to left speakers varies inside the unit circle in the complex plane for a listener in the center of the setup in FIG. 2 is shown in FIG. 3. The crescent section at the top indicates a reversal (wrong ear is louder). The light ring contains values which give no IID error. The indicated complex point (0.485, −0.451) is derived from the usual cross-talk cancellation described in the background at this frequency; that is, with the HRTFs for the center listening location as the elements in the 2×2 matrix, solving for $X_1$, $X_2$ to give the $Y_1$, $Y_2$ at the ears which come from the left rear surround sound location gives $X_2/X_1=0.485, -0.451j$. (The final 0.0 indicates the IID error at this point is, in fact, 0.)

Figure 4:
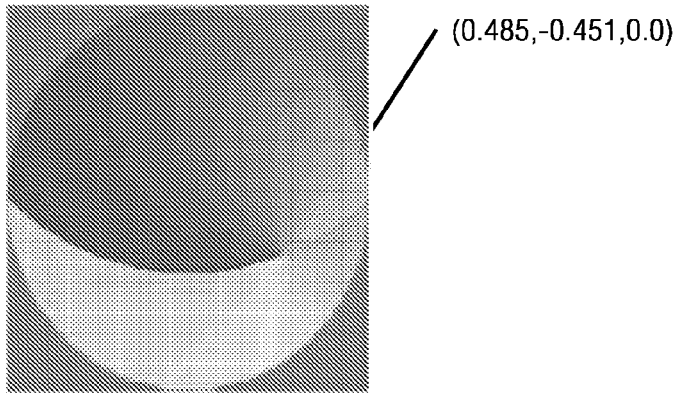

Likewise FIG. 4 shows the absolute ITD error, with the light line representing where the resultant ITD matches the target ITD. The different shading at the top again indicates reversals, in this case caused by earlier arrival at the wrong ear.

Figure 5:
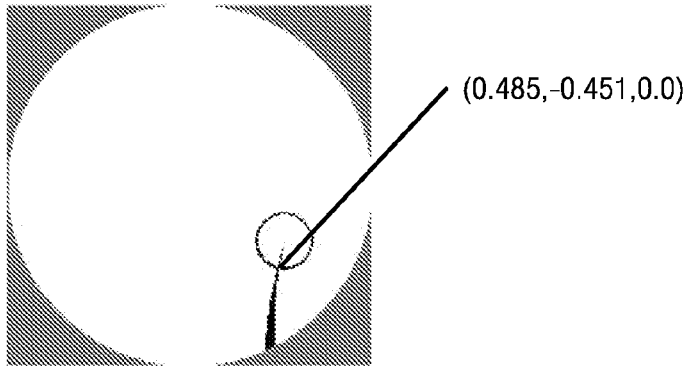

FIG. 5 shows more clearly the intersection of the line of no IID error with the line of no ITD error. Note that for the region inside the ring in FIG. 5, the resultant IID values tend to push the perceived direction off target to the side, while values outside the ring tend to pull the perceived direction to the center, or even to the wrong side (the shaded crescent region in FIG. 3). Likewise in FIG. 5, the resultant ITD values to the left of the line tend to pull the perceived direction to the center while values to the right tend to push the perceived direction to the side, and the shaded area in FIG. 4 indicates where the ITD clue would indicate the wrong side.

Figure 6:
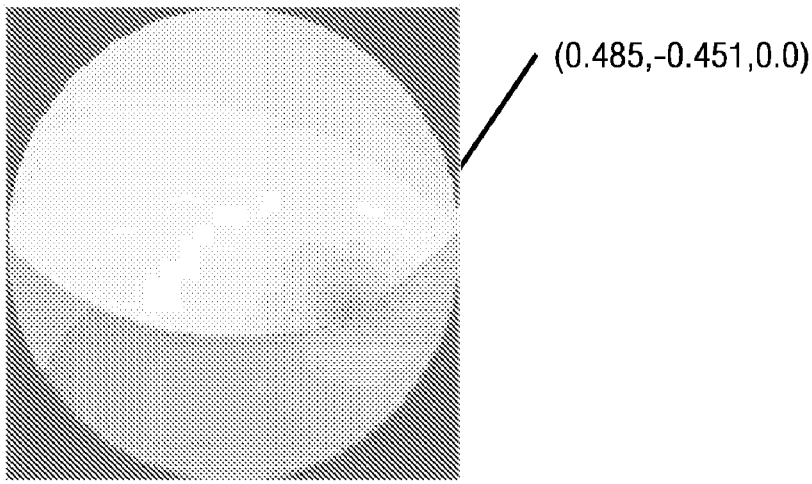
Figure 7:
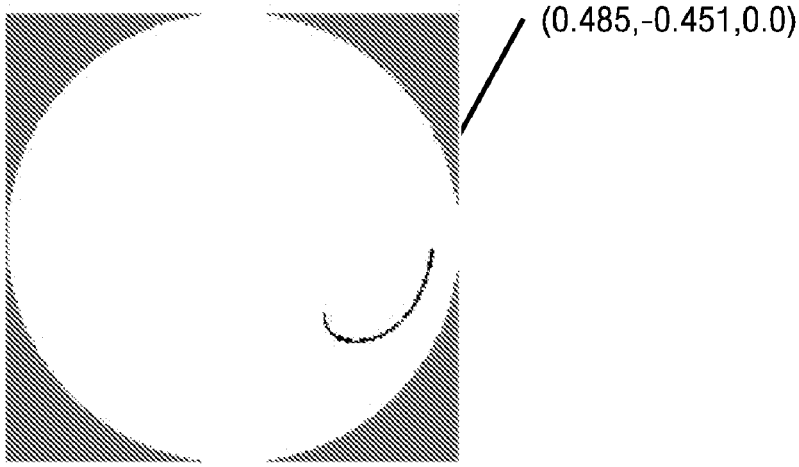

As described in the foregoing, the actual perceived direction will be influenced by both the IID and ITD clues. By converting the ITD clue into a compensating factor in dB units, and adding this factor to the IID values for the corresponding speaker value gives FIG. 6 which shows the composite perceptual error. Here, the white spiral indicates values where the IID error and ITD error tend to correct each other resulting in the correct directional perception. We will call this combined value the Corrected Intensity Difference (CID) since the units are still in dB. A similar approach can be made converting the IID to a millisecond compensation factor and combining with the ITD. CID was chosen for being slightly easier to work with, but both approaches would produce the same result. Notice again that the solution (0.485,−0.451) lies on the spiral of 0 error, which is shown more clearly in FIG. 7. This can be thought of as the point where no trading-off occurs, because there is no IID error and no ITD error. The other points along the spiral in FIG. 7 are where the ITD error compensates for the IID error bringing the CID error to 0.

Of course, the foregoing could be repeated for other listening locations by simply using the corresponding HRTFs as the 2×2 matrix elements.

3. Preferred Embodiment Methods

In order to use CID error to optimize a listening region, first preferred embodiment methods apply the procedure illustrated in the flowchart FIG. 1. This essentially searches over frequencies, speaker output ratios, and head locations for CID error size and thereby identifies head location regions in which for each frequency there exists a speaker output ratio yielding the smallest CID error at all head locations in the region. Then these frequency-dependent speaker output ratios are used in the corresponding virtualizing filters.

More explicitly, for a given listening region perform the nested steps of:

(1) For each frequency $f_i$ to be considered (e.g., 4 samples in each Bark band) perform steps (2)-(6);

(2) For each speaker output ratio $x_m+jy_m$ in a (discrete) search space (e.g., a neighborhood of the usual cross-talk cancellation solution for a central head location) perform steps (3)-(5);

(3) For each head location $(u_n, v_n)$ in a listening region about the central head location, compute the resultant perceived signals at the left and right ears using the matrix equation $$\begin{bmatrix} z_L \\ z_R \end{bmatrix} = \begin{bmatrix} \mathrm{Re}\{H_1\} + j\mathrm{Im}\{H_1\} & \mathrm{Re}\{H_2\} + j\mathrm{Im}\{H_2\} \\ \mathrm{Re}\{H_3\} + j\mathrm{Im}\{H_3\} & \mathrm{Re}\{H_4\} + j\mathrm{Im}\{H_4\} \end{bmatrix} \begin{bmatrix} 1 + j0 \\ x + jy \end{bmatrix}$$

where the $H_k$ are the HRTFs for frequency $f_i$ and head location $(u_n, v_n)$. That is, compute a pair of perceived signals $z_L$, $z_R$ for each $(u_n, v_n)$ in the listening region for each given $f_i$ and $x_m+jy_m$.

(4) Compute the CID error for each of the $z_L$, $z_R$ pairs from (3); that is, for each location in the listening region, compute the difference between the CID of the computed $z_L$, $z_R$ and the CID of the desired signals at the ears (which is the usual cross-talk cancellation solution for a central head location).

(5) From the results of (4), evaluate the CID errors over the listening region for each $x_m+jy_m$, and thereby find the best $x_m+jy_m$ for the listening region. The "best $x_m+jy_m$" may be the one which gives the smallest maximum CID error over the listening region, or may be the one which gives the smallest mean square CID error over the listening region, or may be some other measure of CID error over the listening region.

(6) Use the best $x_m+jy_m$ from (5) to define the virtualizing filter for the given frequency f; and repeat for all other frequencies.

The typical number of frequencies used, number of right-to-left ratios (or left-to-right ratios) used, and number of locations in a listening region used for the computations could be over ten thousand. For example, 25 frequencies, 25 ratios and 25 locations requires 15625 computations.

4. Experimental Results

Figure 8:
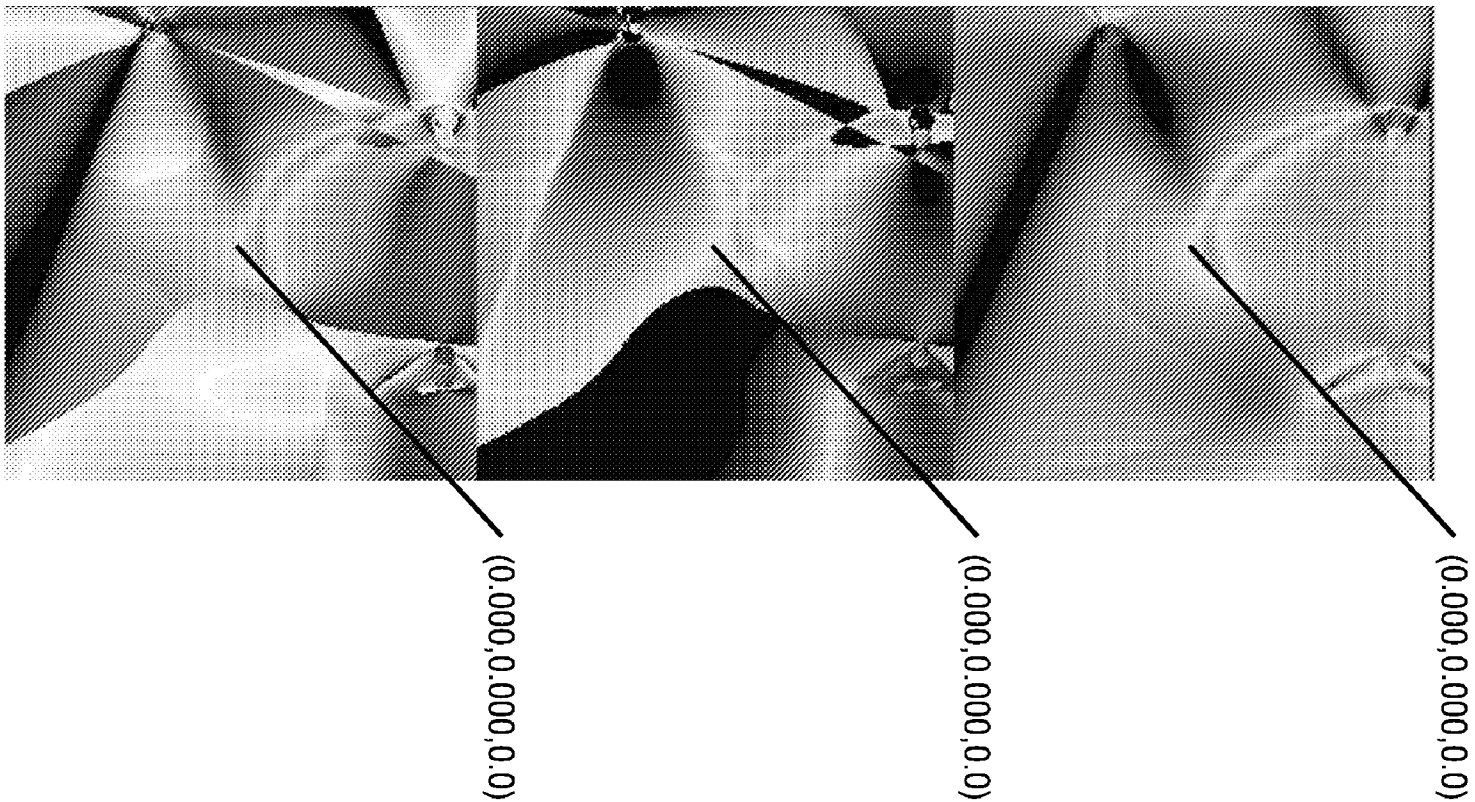

Using the conventional cross-talk cancellation solution at 516.8 Hz, FIG. 8 shows from top to bottom the absolute IID error, the absolute ITD error, and the absolute CID error for a listening region 2 m×2 m. Each point shows the error for a listener's head centered on that point and facing forward. The real and virtual speaker locations are evident as well. Note that 0 error is achieved in each case in the center listening position, marked as the origin (0.000, 0.000). Again the third number in the figures indicates 0 error.

Figure 9:
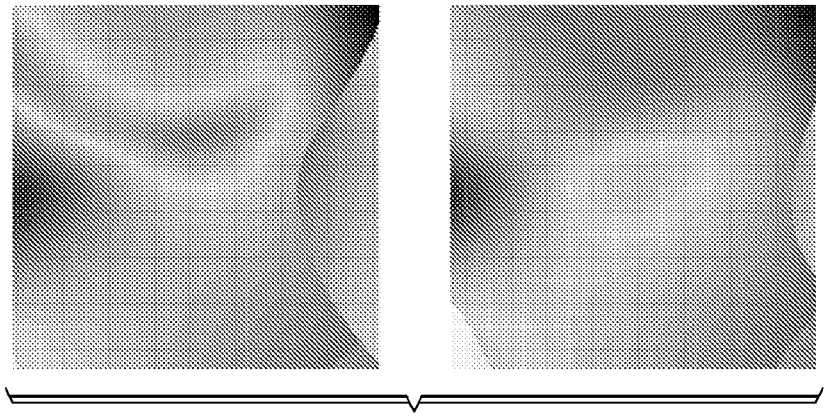

As before, the shaded area in FIG. 8 indicates likely perceptual reversals. One way to improve the sweet spot is to increase the size of the area in which no reversals occur. For the traditional cross-talk cancellation solution, the largest box around the center location that contains no reversals is approximately 0.34 m×0.34 m. This is not the optimal result however. By doing a search for larger boxes with no reversals, a better solution, which is represented by the complex number (0.64, −0.4), was found. This solution increased the area with no reversals to approximately 0.51 m×0.51 m. A comparison of the cross-talk cancellation solution and the preferred embodiment solution using CID error in a 0.6 m×0.6 m region around the center is shown in FIG. 9. Again the locations where the CID indicates a reversal are shaded.

Note, however, that the center CID error is now equivalent to about −1.87 dB, pulling the virtual direction slightly toward the center. Also the total error in the box in FIG. 8 increased slightly (2.3%) in the preferred embodiment solution. However, looking at a box 0.4 m×0.4 m around the center, the preferred embodiment solution reduces the total error by almost 11%, and has no reversals in this smaller region while the traditional cross-talk cancellation solution has some reversals still.

In addition to increasing the space with no reversals, the total error can be minimized over some arbitrary region. For instance, trying to reduce the total CID error over a 0.1 m×0.1 m box around the center, the total error can be reduced by over 50% (approximately 53%). In this case the error at the center is equivalent to −0.334 dB.

Figure 10:
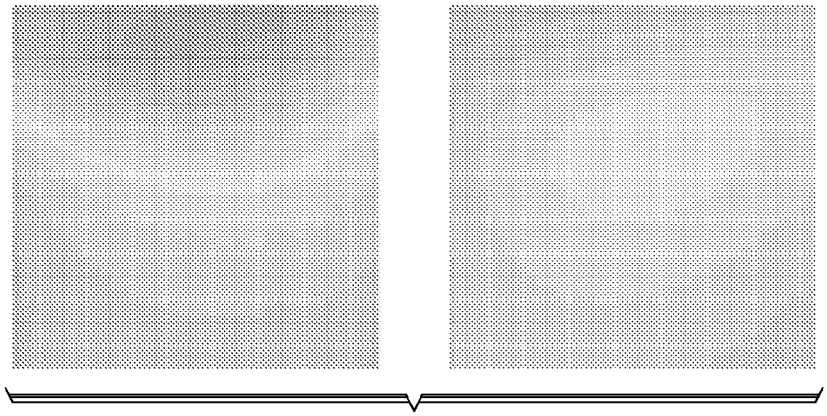

Another approach is to constrain the solution to keep the center CID error as small as possible while reducing total error. In this example, the total error in the 0.1 m×0.1 m region can still be reduced by 48.6% while keeping the error in the center at the equivalent of −0.049 dB. FIG. 10 shows the comparison of these regions.

Although these examples have focused on one particular frequency and speaker setup, the technique of using CID to optimize various aspects of the sweet spot can be applied in any situation.

Figure 11:
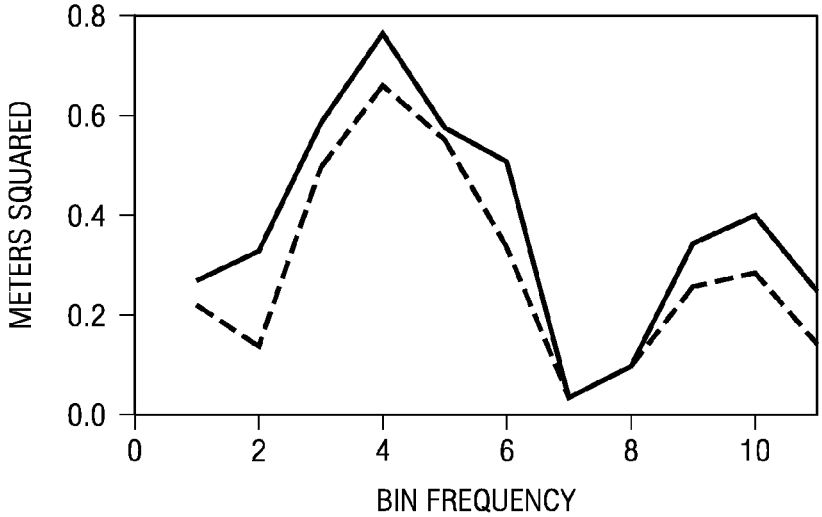

Optimizing the current setup (i.e., setting crosstalk cancellation filter frequency response) at various frequencies shows some interesting phenomenon. At bin frequencies which are multiples of 86.13 Hz, the largest box around the center position without reversals for the traditional cross-talk cancellation solution was calculated for frequencies less than 1014 Hz (11 bins). Then a search was done at each frequency for better solutions. The results are shown in FIG. 11. The size of the largest box without reversals and the amount of improvement achievable is not related to the change in frequency in any obvious way. However, the preferred embodiment solution was often better, and sometimes significantly better than the traditional cross-talk cancellation solution.

Figure 12:
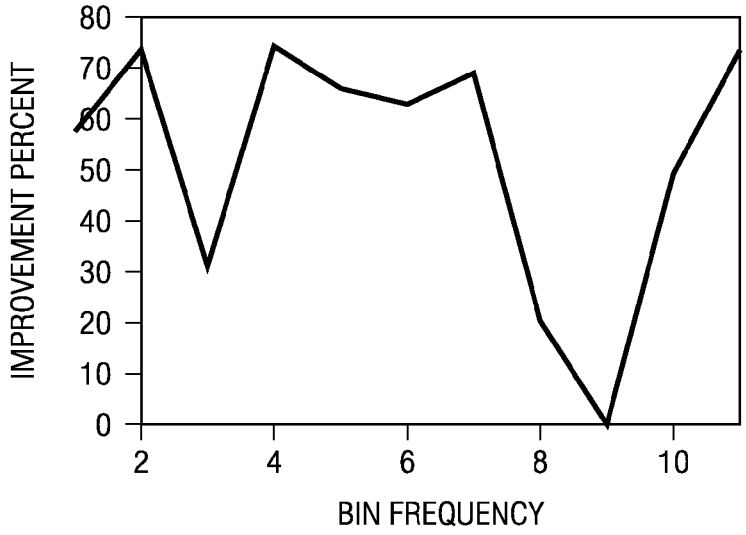
Figure 13:
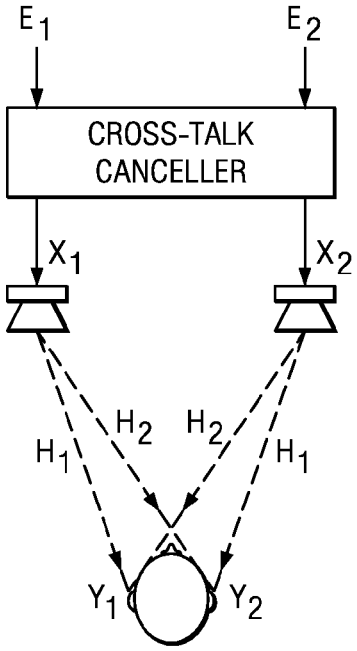
FIG. 13 (PRIOR ART)
FIGS. 13-14 show cross-talk cancellation and virtual speaker locations.

Another experiment was done, in which the goal was to minimize the CID error in a box 0.2 m×0.2 m around the center location. The results of this effort are shown in FIG. 12 where the error reduction of a preferred embodiment method filter compared to the traditional crosstalk cancellation method filter is plotted with 100% representing removal of all CID error and 0% representing no improvement over the traditional method.

Additional criteria, such as applying a weighting of error within the region, can also be applied. For instance the error near the center can be given more weight than the error near the edges. Also the weighting over the region can be different for different frequencies. Thus a weighting scheme that takes into account the relative importance of different frequencies for the different HRTFs at different locations could be used.

5. Modifications

The preferred embodiments can be modified in various ways while retaining one or more of the features of evaluating CID error to define virtualizing filters for specified listening regions ("sweet spaces").

For example, the number of and range of frequencies used for evaluations could be varied, such as evaluations from only 10 frequencies to over 100 frequencies and from ranges as small as 100-400 Hz up to 2 kHz; the number of locations in a candidate listening region evaluated could vary from only 10 locations to over 100 locations and the locations could be uniformly distributed in the region or could be concentrated near the center of the region; the number of ratios for evaluations could vary from only 10 ratios to over 100 ratios; listening regions could be elongated rectangular, oval, or other shapes; the listening regions can also be arbitrary volumes or surfaces and can consist of one or more separate regions. The approximation function used to calculate the CID can be changed for different angles, increased bandwidth, and even for different listeners, to best reflect the psychoacoustic tradeoff between IID and ITD in a given situation. Other audio enhancement technologies can be integrated as well, such as room equalization, other cross-talk cancellation technologies, and so on. Even other psychoacoustic enhancement technologies such as bass boost or bandwidth extension and so on may be integrated. Also more than two speakers can be used with corresponding larger transfer function matrices.

What is claimed is:

1. A virtualizer, comprising:

(a) input for left and right audio signals corresponding to a source;

(b) output for processed audio signals to right and left speakers, and (c) a processor coupled to said input and said output, said processor operable to convert said left and right audio signals into said processed audio signals which virtualize said source in a listening region related to said right and left speakers;

(d) wherein said listening region is determined from evaluations of a corrected interaural difference computed from an interaural intensity difference (IID) and an interaural time difference (ITD) for frequencies up to about 1 kHz; and (e) wherein said evaluations include determinations of a ratio for said signals to right and left speakers for each frequency in a search set and each candidate listening region in a search set by:

(i) for a first location in said candidate listening region computing an interaural intensity difference (IID) and an interaural time difference (ITD) at said frequency and with a first ratio for signals to right and left speakers;

(ii) computing a first corrected interaural difference (CID) for said first ratio from said first IID and first ITD for said first ratio;

(iii) computing a first CID error for said first ratio using a desired CID;

(iv) repeating steps (i)-(iii) for second, third, . . . , Nth locations in said candidate listening region where N is an integer equal to or greater than 10;

(v) evaluating the results of steps (i)-(iv) for said first ratio;

(vi) repeating steps (i)-(v) for second, third, . . . , Mth ratios where M is an integer equal to or greater than 10; and (vii) selecting one of said M ratios according to said evaluations.

2. The virtualizer of claim 1, wherein said evaluating of (v) is by maximum absolute CID error.

3. The virtualizer of claim 1, wherein said evaluating of (v) is by mean squared CID error.

4. The virtualizer of claim 1, wherein said evaluating of (v) is maximum number of non-negative CID errors.

5. The virtualizer of claim 1, wherein said listening region is the largest of said candidate listening regions for which said evaluation (v) for said selected one of said M ratios for each of said frequencies is less than a threshold.

* * * * *